US005379573A

United States Patent [19]

Greenwell

[11] Patent Number: 5,379,573

[45] Date of Patent: Jan. 10, 1995

[54] CARTON FLAP CLOSING APPARATUS

[75] Inventor: Joseph D. Greenwell, Florence, Ky.

[73] Assignee: R. A. Jones & Co. Inc., Crescent Springs, Ky.

[21] Appl. No.: 20,210

[22] Filed: Feb. 19, 1993

[51] Int. Cl.[6] ..... B65B 7/20; B65B 51/02

[52] U.S. Cl. ..... 53/491; 53/376.5; 53/377.2

[58] Field of Search ..... 53/491, 484, 376.5, 53/377.2, 376.7

[56] References Cited

U.S. PATENT DOCUMENTS

| | | | |
|---|---|---|---|
| 3,258,893 | 7/1966 | Jones | 53/564 X |
| 3,418,892 | 12/1968 | Dieter et al. . | |
| 3,504,478 | 4/1970 | Dieter | 53/376.5 X |
| 3,832,822 | 9/1974 | Sherman | 53/377.2 X |
| 4,348,853 | 9/1982 | Morse et al. | 53/377.2 X |
| 4,480,421 | 11/1984 | Rece | 53/75 |
| 4,592,190 | 6/1986 | Sherman et al. | 53/491 |
| 4,713,928 | 12/1987 | Tisma | 53/377.2 X |

*Primary Examiner*—James F. Coan
*Attorney, Agent, or Firm*—Wood, Herron & Evans

[57] ABSTRACT

An end flap sealer for a cartoning machine for performing the step of closing and sealing at least one of the end flaps of each carton travelling along the conveyor of the cartoning machine. The cartoning machine includes a movable closer plow mounted adjacent the conveyor and having a top edge that slopes downwardly toward the approaching cartons on the conveyor of the cartoning machine. The closer plow is attached to a sliding member that is reciprocated to extend the closer plow above the conveyor of the cartoning machine as the carton moves adjacent the closer plow to fold the outermost end flap into a closed position against the other end flaps of the carton. The sliding rod is preferably angled toward the approaching cartons on the conveyor, such that the plow has components of motion both toward and away from entering cartons. The plow can be extended earlier and retracted sooner, providing increased compression duration and increasing cartoning speeds.

21 Claims, 2 Drawing Sheets

CARTON FLAP CLOSING APPARATUS

BACKGROUND OF THE INVENTION

This invention generally relates to a cartoning machine and more specifically to an end flap sealing mechanism to close and seal the end flaps of cartons travelling along the conveyor of the cartoning machine.

Cartoning machines to which the present invention is applied are conventional ones which have been used in the packaging industry for years. The present invention is adaptable for use with cartoning machines which carry cartons in a horizontal, sloping, or vertical direction.

During the packaging of products using such cartoning machines, the cartons are erected and delivered into pockets between transport lugs that are carried on an endless chain conveyor. At least one end of each carton has open flaps to which a hot melt glue is applied at a gluing station. Downstream of the gluing station, a plow mechanism compresses the flaps together and holds them for a period of time sufficient to permit the glue to permanently set. The other end of the carton may also have flaps which are to be glued and plowed closed or may alternatively have tuck flaps which are closed by a conventional mechanism.

Prior flap closing mechanisms have included both stationary plows and movable plows. Stationary plows have been conventionally used to close the outermost end flap against the other end flaps as the carton, traveling along the conveyor, passes the stationary plow which is mounted adjacent the conveyor. The stationary plows have outwardly flared and, for example, downwardly tapered upstream ends which engage the outermost end flap and force it to pivot to a closed position as the carton moves along the conveyor. Downstream from the outwardly flared portion, the stationary plow includes a planar portion generally parallel to the ends of the cartons being sealed. This planar portion maintains compression on the end flaps of the moving cartons while the glue permanently sets.

One prior moving plow for folding the outermost end flap of a carton against the other end flaps of the carton after glue has been applied in a cartoning process is disclosed in U.S. Pat. No. 3,504,478 to Dieter and entitled AUXILIARY END FLAP SEALER FOR CARTONING MACHINE. The auxiliary end flap sealer of Dieter includes an end flap closer operating on a hinge mechanism actuated by a pneumatic cylinder. The end flap closer is positioned in the glue applying area of the cartoning machine and may be rotated approximately 90° between a position in which the closer does not affect the position of the carton end flaps and a position in which the closer holds the end flaps in final sealing position. The closer is actuated only upon normal or emergency shutdown of the cartoning machine.

Another prior patent which discloses carton flap sealing is U.S. Pat. No. 4,480,421 to Rece entitled AUXILIARY FLAP SEALER FOR A CARTONING MACHINE. Rece discloses a mechanism to complete the gluing if gluing has been partially completed when the cartoning machine stops for some reason and to force and hold the flaps together until the glue sets. Specifically, Rece discloses a control system to determine whether glue has been partially or fully applied to the end flap of a carton when the machine has shut down for any reason. If glue has been partially applied then the control system causes the gluing application to be completed and a plow to be moved in an upstream direction to seal the carton. If the gluing operation was complete upon shutdown of the machine then no further glue is applied but the plow is moved in an upstream direction to seal the carton.

A movable plow is also known in which the plow is mounted adjacent the conveyor of a cartoning machine to reciprocate at a 90° angle to the moving cartons. The plow has a top edge that is parallel to the path of the cartons moving down the conveyor. The top edge is adapted to engage and fold the outermost end flap of the carton inwardly to seal it against the other end flaps. One disadvantage of this design is that the plow must be moved back to its start-up position, below the lower edge of the incoming carton, before the conveyor may be caused to move the incoming carton into position adjacent the movable plow. If the next carton is moved toward the plow before it is fully retracted then the flaps of the carton will hit the plow and either damage the carton or move it out of its proper position on the conveyor.

It will also be appreciated in connection with carton closures using hot melt glues that it is desirable to close the carton flaps immediately after glue applications, thus avoiding the possibility that the glue will set up before such closure and the seal will not function properly.

Accordingly, it has been one objective of the invention to provide an improved movable plow mechanism for folding and sealing the end flaps of a carton as the cartons move past the plow to increase the speed of the cartoning operation.

It has been another object of the invention to increase the amount of time that the end flaps are initially held under compression by a movable plow to minimize end flap relaxation and prevent end flaps from unfolding and buckling against parts of the cartoning machine before the cartons are moved by the conveyor downstream to a location where the end flaps engage a stationary plow.

It has been another objective of the invention to decrease the time delay between hot melt glue application and carton flap closure to reduce seal inconsistencies.

SUMMARY OF THE INVENTION

To these ends, a preferred embodiment of the present invention contemplates the interposition of at least one movable plow alongside a carton machine conveyor downstream of a gluing station. The plow is so shaped and has components of motion toward and away from entering cartons such that it can be retracted later and extended earlier, providing increased compression time for carton end flap glue set up and increased cartoning speeds. The preferred embodiment of the present invention contemplates a cartoning machine wherein cartons move along the conveyor of the cartoning machine with each carton having at least one outwardly extending end flap to be closed and sealed against other end flaps.

The cartons first move past a gluing station where a bead of glue is applied to either the inner side of the outermost end flap or an outside surface of one of the end flaps which has been folded inwardly by a conventional mechanism located upstream of the gluing station. The cartons then move along the conveyor into a position in which they are engaged by either one or two movable plows to close and seal the end flaps. Two movable plows are necessary when end flaps on opposite sides of the cartons are to be closed and sealed, while only one movable plow will be necessary if one of the ends of the carton has, for example, a conventional tuck flap configuration which has been closed in a conventional manner at an upstream location. In the latter case a stationary plow will normally be necessary on the tuck flap side of the carton in order to hold the carton in place as the opposite side of the carton is sealed by the movable plow.

After the end flaps have been closed and sealed, the movable plows are retracted as the conveyor moves the carton downstream between two stationary plows to maintain compression on the end flaps until the glue permanently sets thereby firmly adhering the end flaps to one another. While the movable plows are being retracted, the conveyor begins to move the next carton toward the movable plows. Once this carton is in place, the movable plows are again cycled into an extended position to fold and seal the end flaps.

The carton flap closer of the present invention preferably includes twin movable plow assemblies mounted adjacent opposite sides of the carton conveyor. Each movable plow has a top edge which slopes downwardly toward the approaching cartons on the conveyor. The top edge is also flared or beveled outwardly to provide a leveraging effect as the movable plow is raised with respect to the cartons moving along the conveyor to engage the outermost end flaps of each carton and fold them inwardly and upwardly to compress them against the other end flaps of the carton. Each movable plow is mounted to reciprocate in timed relation to the movement of the cartons along the conveyor. The timed reciprocation of the end flap closing mechanism of the invention may be obviously designed to work in conjunction with either a constant motion cartoning machine or an intermittent cartoning machine.

The movable plows are operatively connected to a cam arrangement driven off of the drive assembly for the conveyor of the cartoning machine. Each movable plow is connected to a sliding rod which slides between the rotatable journals of a slideway assembly along a path that is angled upwardly toward and downwardly away from the approaching cartons on the conveyor. The sliding rod is pivotally connected to one end of a linkage rod the opposite end of which is connected to the free end of a lever having its other end attached to a cam shaft. The cam shaft operates to reciprocate the lever through a predetermined angle in response to the movements of a cam follower which is attached to the cam shaft and rides in a cam groove of a wheel. The cam groove is shaped to cause reciprocation of the cam shaft and corresponding reciprocation of the movable plows in timed relation to the movement of the cartons along the conveyor. The cam wheel is preferably rotated off of the drive system used to drive the conveyor of the cartoning machine.

As previously stated, the top edge of each movable plow slopes downwardly toward the approaching cartons on the conveyor and the path of reciprocation of each movable plow is also angled toward the approaching cartons. This geometry allows more time to elapse before the movable plows must be retracted and, therefore, more time to maintain the carton end flaps under compression. The shape of the movable plow and the angle of reciprocation also allow the conveyor to move the next carton into position sooner than was previously possible since the next carton may be moved, without stubbing the end flaps against the movable plow, as soon as the upstream end of the angled top edge of the movable plow is retracted below the leading edge of the incoming carton. Since the top edge of the movable plow is angled downwardly toward the approaching cartons, the upstream end of the top edge is always in a relatively low position and therefore need only be retracted a small amount before the next carton may be moved into position between the movable plows.

It is thus unnecessary to delay movement of the carton from the gluing station into the flap compression until the moving plow is fully retracted. The orientation, shape and angle of motion of the plow allow initiation of carton motion into the flap compression area at an earlier time, thus facilitating increased cartoning speeds. Moreover, since the retracting plow has a component of motion in the direction of the retreating carton that has just been sealed, flap compression times can be extended, facilitating the adhesive set-up and increasing compression time and thus reducing loss of flap adhesion due to insufficient compression time. Finally, it should be appreciated that cartoning machines are called upon to handle different sized cartons. The invention facilitates handling the larger sizes of any carton range in view of the plow's component movement in retraction away from the next cartoning being glued and entering the compression area.

Other objects and advantages will be readily apparent to those of ordinary skill in the art from the following detailed description taken in conjunction with the accompanying drawings.

General Organization

Figure 1:
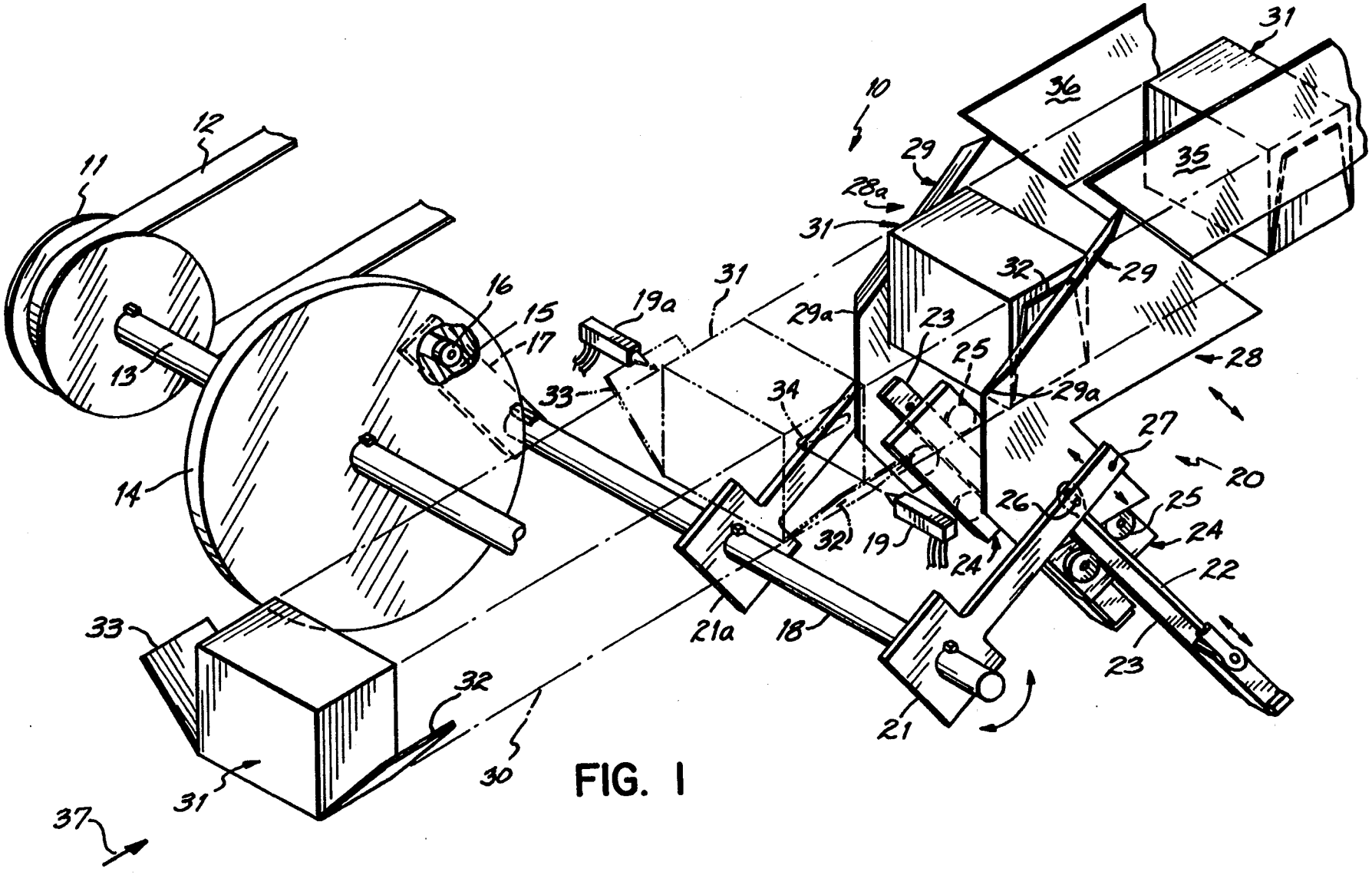
FIG. 1 is a diagrammatic perspective view of a carton end flap sealing station of a cartoning machine showing the carton flap closer of the present invention and with arrows indicating direction of motion of various machine elements.

Referring first to FIG. 1, a small portion of a conventional cartoning machine is illustrated diagrammatically in perspective view. For clarity, much of the cartoning machine, such as the carton feeding and erecting mechanism and the carton loading mechanism, is eliminated since those mechanisms form no part of the present invention.

As is conventional, cartons 31 are carried between trailing lugs and leading lugs (not shown) in the direction of the arrow 37 on a path 30 representing the path of the conveyor of the cartoning machine. The carton 31 has opposite outermost end flaps 32, 33 to be closed and sealed by the carton flap closer of the present invention. Conventional flap closing mechanisms are employed to swing the remaining end flaps, usually consisting of inner and upper end flaps (not shown), into a closed position at a location upstream of the flap closing mechanism of the present invention. The present invention will be described in connection with closing and sealing both ends of a carton, however, the invention is also easily adaptable to close and seal only one end of a carton. In this regard, only one movable plow or carton flap closer means 20 would be employed on the side of the carton having end flaps to be sealed while the other side of the carton would be engaged by, for example, a stationary plow to hold the carton in place during the sealing operation. Also, the invention will be described in connection with a cartoning machine having a horizontally oriented conveyor, however, the carton flap closer is easily adapted to work with conveyors having other orientations such as sloping or vertical orientations.

In addition, it will be appreciated that while the invention is described with a plow mounted from an area beneath the cartons for sweeping the end flaps upwardly, the plow could be mounted above the carton path to sweep end flaps downwardly.

Conventional glue guns 19, 19*a* are mounted on opposite sides of the conveyor at a position just upstream of the end flap closing mechanism of the present invention for applying glue to an outside surface of one or more of the end flaps of each carton which have previously been folded inwardly at an upstream location. The glue guns 19, 19*a* may alternatively be oriented to apply glue on the inner side of the outermost end flap. This glue gun is supplied with hot melt adhesive from a conventional source (not shown). As is also conventional, the glue gun may be adjustable mounted on a suitable bracket to permit the adjustment of the vertical orientation of the glue nozzle to permit the cartoner to be changed over to different types and/or sizes of cartons. The gun may also be mounted such that its longitudinal position with respect to the movable plow 28 may be altered for similar change-over purposes, or mounted on a mechanism to move it toward and away from the carton during normal operation.

As further shown in FIG. 1, the carton flap closing station 10 includes a carton flap closer means 20 mounted at a position just downstream of the glue guns 19, 19*a*. The carton flap closer means 20 includes a pair of opposed movable plows 28, 28*a* mounted for reciprocation along a path which is generally transverse to, or intersects, the path 30 of the conveyor. The path of reciprocation is preferably angled toward the approaching cartons 31 on the conveyor, such that it moves up with an upstream component of motion and down with a downstream component of motion.

The movable plows 28, 28*a* are reciprocated by a mechanism which operates in timed relation to the movement of the cartons 31 along the path 30 of the conveyor. The design of the reciprocation mechanism allows the movable plows 28, 28*a* to begin to extend as the cartons move past the gluing station and the leading edge of each carton just passes the upstream end 29*a* of the top edge 29 of each movable plow.

In an intermittent motion cartoning machine, the carton will stop when it is fully contained between the two movable plows 28, 28*a* for a brief period during which time compression 15 applied to each set of end flaps while the glue initially sets. In a constant motion cartoning machine, the carton will be constantly moving as the movable plows 28, 28*a* are extended and retracted by the reciprocation mechanism. In the case of both an intermittent motion cartoning machine and a constant motion cartoning machine, the cartons 31 are moved by the conveyor to a location immediately downstream of the movable plows 28, 28*a* and between opposed stationary plows 35, 36 which maintain compression against the ends of the cartons 31 in order to allow the glue applied to the end flaps to permanently set. The cartons 31 are then ready to be processed further, i.e., packaged in larger cartons, etc., at locations downstream of the carton flap closing and sealing station 10.

The Carton Flap Closer

As shown in FIG. 1, the carton flap closer 20 of the present invention includes identical movable plows 28, 28*a*, with each movable plow being mounted for reciprocation along a path defined by the axis of a sliding rod 23 which is generally transverse to the path 30 of the conveyor and angled toward the approaching cartons 31 on the conveyor as shown. Each movable plow 28, 28*a* is mounted to an identically designed linkage and sliding assembly which, for the most part, are mirror images of each other. Therefore, for clarity, only one of these reciprocating movable plows 20 will be described in detail, with the understanding that the other movable plow assembly is designed and operates in exactly the same manner.

The carton flap closer 20 includes a movable plow 28 rigidly secured to a sliding rod 23 by fasteners 38. The sliding rod or arm 23 is slidably received by a slideway assembly 24 having a plurality of opposed rotating journals or bearings 25. The slide preferably has tapered sides which are captured by tapered bearings 25. Such a glide mount 24, i.e. arm 23, journals 25, etc., can be of any suitable type. One suitable type is Part No. BWC 5437 manufactured by Biship Wisecarver Company of Pittsburg, Calif. A lower end of the sliding rod 23 is pivotally attached to one end of a linking rod 22. The other end of the linking rod 22 is pivotally attached to the outer, free end of a lever 21 by fastener means 26. The stroke of the sliding arm 23 may be varied to accommodate cartons of different sizes by varying the location of the attachment of the linking rod 22 along the length of the lever 21. One additional aperture 27 is shown on the lever 21 to provide for adjustment of the stroke. Additional apertures may be provided on lever arm 21 to increase the adjustability of the stroke of the sliding arm 23.

The opposite end of the lever arm 21 is rigidly secured to a cam shaft 18. A cam follower 16 is attached to the cam shaft 18 by a connecting bar 17 and the cam follower 16 is situated in a suitably shaped cam groove 15 (only a portion is shown) in a cam wheel 14. The cam wheel 14 is preferably driven off of the drive mechanism that drives the conveyor of the cartoning machine. This drive mechanism is partially shown in FIG. 1 and includes a drive belt 12 driving a wheel 11 which in turn drives a shaft 13 connected to the cam wheel 14.

The cam mechanism is designed to rotate the cam shaft 18 back and forth through a predetermined angle and thus pivot the lever arm 21 through the same predetermined angle. The pivoting action of the lever arm 21 causes reciprocation of the movable plow 28 since, through the linking arm 22, this pivoting action will cause sliding movement of the arm 23 within the slideway 24. The cam mechanism and the linkage assembly for the carton flap closer 20 are designed to reciprocate the closer plow 28 in timed relation to the movement of the carton 31 along the conveyor of the cartoning machine. The necessary design parameters to create this timed reciprocation of the carton flap closer 20 will be within the ordinary mechanical ability of the artisan of ordinary skill taking into consideration design parameters of the cam groove, the spacing between each carton on the conveyor, the carton size, and the drive mechanism of the conveyor.

As further shown in FIG. 1, the closer plow 28 has a top edge 29 which slopes downwardly toward the approaching cartons 31 on the conveyor. Also, the top edge 29 of the closer plow 28 is preferably flared or beveled away from the cartons 31 on the conveyor to provide leverage as the closer plow 28 is raised against the outermost extending end flap 32 to fold it upwardly and inwardly and seal it against the other end flaps of the carton 31. The relatively low position of the upstream end 29*a* of the top edge 29 allows the closer plow 28 to remain in position against the end flaps of the carton 31 for a longer period of time than was previously possible. This results from the fact that the closer plow 28 needs to be lowered only a small amount before the next carton may be moved past the upstream end 29*a* of the top edge 29 of the closer plow 28 without having the end flaps of the carton buckle against the closer plow 28. The advantages realized from the geometrical design of the movable plow 28 and reciprocation mechanism will be more readily apparent by reference to FIGS. 2 and 3.

Figure 2:
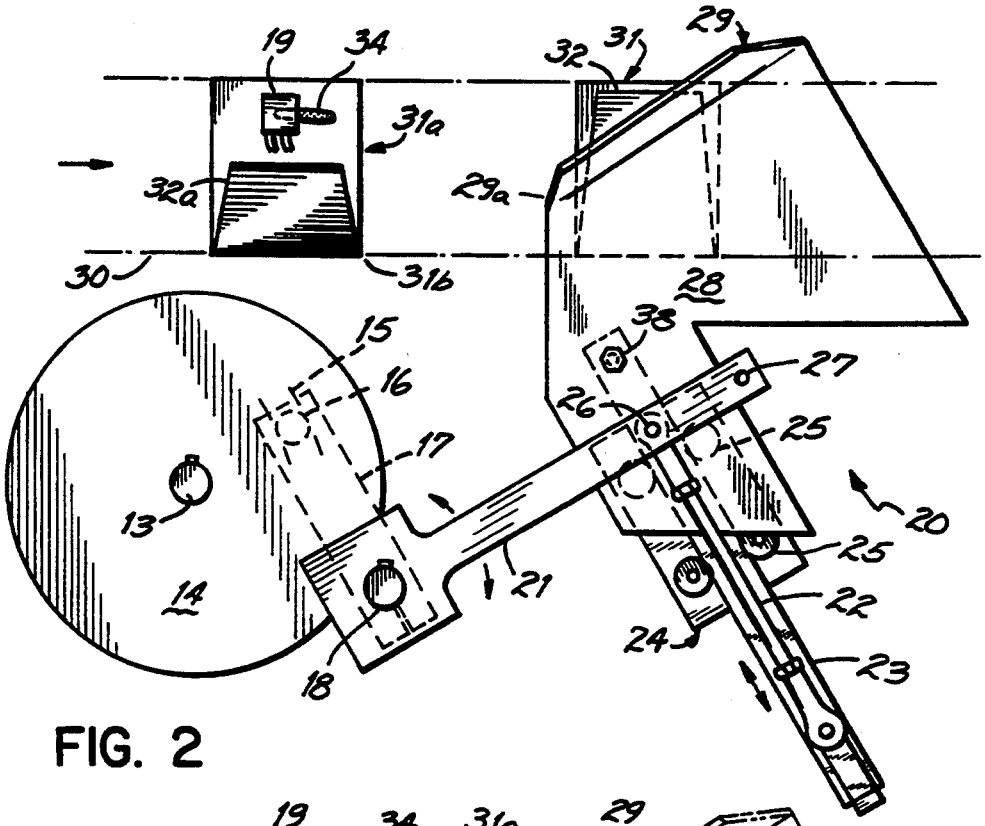
FIG. 2 is a diagrammatic elevated side view of the carton flap closer showing the movable plow in an extended position with arrows indicating direction of movement; and, FIG. 3 is a diagrammatic side elevational view showing the extended and retracted positions of the closer plow and its associated linkage assembly, with arrows indicating direction of movement.

FIG. 2 shows the movable plow 28 in its uppermost position with a carton 31 in the process of moving along the conveyor in a sealing or flap compression position adjacent the movable plow 28 with the plow completely covering the end of the carton. In the case of an intermittent motion cartoning machine, the conveyor will stop and allow the plow 28 to maintain compression on the end flap 32 to initially seal the end flap 32 against the other end flaps of the carton 31. The glue gun 19 is shown to be in the process of applying a bead of glue 34 to the next incoming carton 31*a* as that carton moves along the path 30 of the conveyor.

Figure 3:
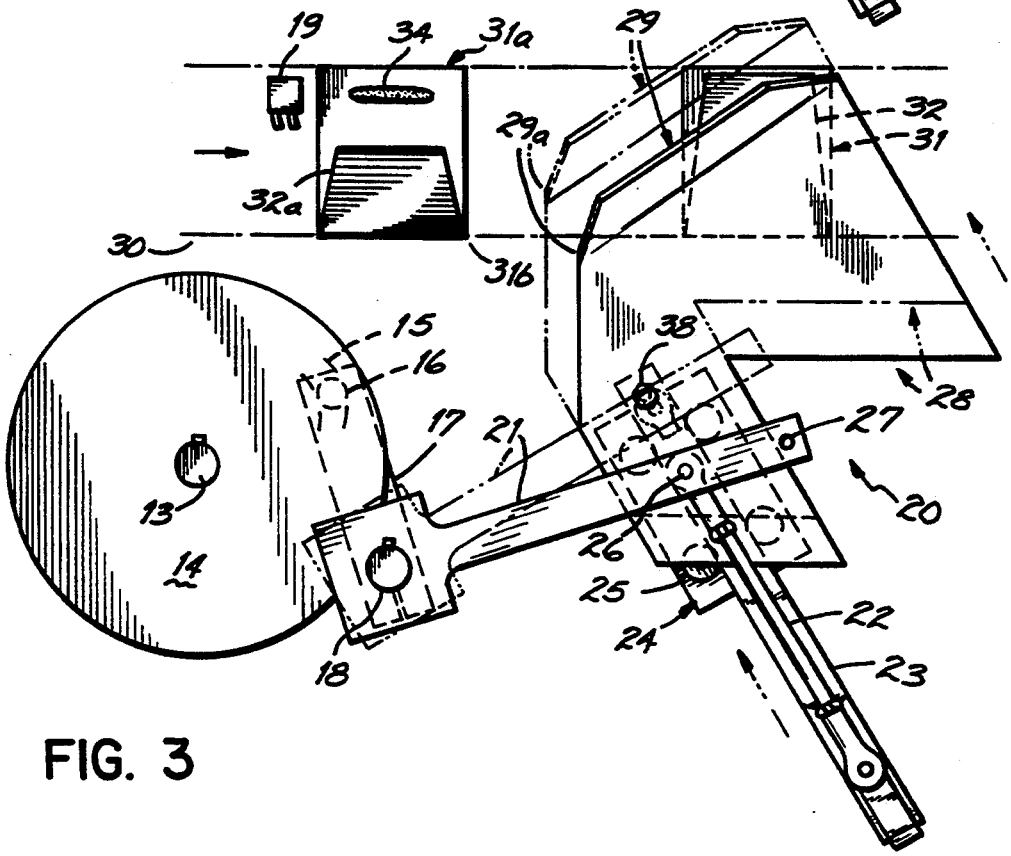

In FIG. 3 the carton flap closer 20 is shown (in solid lines) with the closer plow 28 being in a retracted position for contrast. Here, the upstream end 29*a* of the upper edge 29 of the closer plow 28 is positioned below the lower leading edge of the incoming carton 31*a*. The closer plow 28 is also shown (in phantom)in its fully extended position. Here, the lever 21 has been pivoted to its uppermost position (also shown in phantom) with the pivoting action of the lever 21 having caused the arm 23 to slide upwardly and extend the closer plow 28. The carton 31 is shown at rest in a position adjacent the closer plow 28 in which compression is being applied for a period of time sufficient to allow the glue to initially set. This period of time allows the glue to dry enough to prevent relaxation of the end flaps when the carton later moves to a position downstream of the movable plow 28. Such relaxation could cause the end flaps to unfold and possibly buckle against parts of the cartoning machine.

As further shown in FIG. 3, the upstream end 29*a* of the top edge 29 of the closer plow 28 is shown (in solid lines) to be below the lower leading edge 31*b* of the incoming carton 31*a* to prevent stubbing of the end flaps against the closer plow 28. The closer plow 28 is maintained in a retracted position at least until the incoming carton 31*a* moves downstream such that its leading edge moves to a point just past the upstream end 29*a* of the top edge 29 of the closer plow 28. Due to the sloping top edge 29 of the closer plow 28 and the fact that the closer plow 28 is retracted on a path sloping away from the approaching cartons on the conveyor, the conveyor may start to move the cartons before the closer plow has been completely retracted by the reciprocation mechanism. As previously stated, this feature results from the fact that the upstream end 29*a* of the top edge 29 need only be lowered a very small amount before the upstream end 29*a* of the top edge 29 reaches a point below the leading edge 31*b* of the incoming carton 31*a*. Also, since the closer plow 28 is retracted with a component of motion on a path that moves the closer plow away from the incoming carton 31*a*, the carton 31*a* may begin to move that much sooner toward the closer plow 28 without risking stubbing the carton 31*a* against the upstream end of the closer plow 28.

In other words, the retracting plow retreats partially in the same direction as the incoming carton. At the same time, the retreating motion is also partially in the same direction as the compressed carton, thus desirably extending compression time.

Operation

The operation of the invention will be discussed in terms of its use on an intermittent motion cartoning machine, however, it should be understood that the reciprocation mechanism may be easily designed by one of ordinary skill to reciprocate in timed relation to the movement of cartons in a constant motion cartoning machine as well.

In FIG. 1, cartons 31 are shown to be moving along a path 30, representing the path of the conveyor of the cartoning machine, in the direction of the arrow 37. The cartons 31 are conventionally positioned between lugs (not shown) which carry the cartons along the conveyor. Each carton 31 has a plurality of end flaps, with the outermost unfolded end flap on each end of the carton 31 being angled outwardly as it enters the carton flap closing station 10. The remaining end flaps of each carton have been folded inwardly at upstream locations by conventional mechanisms.

Referring now to FIG. 2, a glue gun 19 is shown in the process of applying a bead of glue 34 to one or more of the inner end flaps as the carton 31*a* moves along the conveyor in the direction of the arrow 37. At the same time, the next carton 31 downstream of the carton 31*a* is having its outermost end flap 32 closed, compressed and sealed against the other end flaps. In FIG. 2 the movable plow 28 is shown to have just reached its uppermost extended position, where it will remain for a period of time sufficient to apply compression to the end flaps thereby causing the glue to initially set. After this period of time, the cam wheel 14 rotates to cause the lever 21 to pivot downwardly and retract the movable plow 28 as the conveyor carries the next carton 31*a* toward the movable plow 28.

As shown in FIG. 3, the movable plow 28 is retracted until the upstream end 29*a* of its top edge 29 reaches a position below the lowermost leading edge 31*b* of the carton 31*a*. As soon as the upstream end 29*a* of the top edge 29 of the movable plow 28 has been retracted to this position, the incoming carton 31*a* may be moved by the conveyor such that its lowermost leading edge 31*b* moves past the upstream end 29*a* of the top edge 29 of the closer plow 28. The incoming motion and plow retraction, however, may be concurrent.

It will also be appreciated that the retracted plow may still be in compression contact with the flaps of carton 31.

The outermost end flap 32*a* of carton 31*a* will preferably begin to be folded upwardly as the conveyor moves the carton 31*a* adjacent the movable plow 28 since the end flap will begin to be folded upwardly through its engagement with the top edge 29 of the plow 28 as the carton 31*a* moves along the conveyor. Once the leading edge of the carton 31*a* passes the upstream end 29*a* of the top edge 29 of the closer plow 28, the cam wheel 14 will have rotated to a point where the cam shaft 18 begins to pivot the lever arm 21 upwardly to extend the closer plow 28 to completely fold and seal the end flap 32*a* against the other end flaps.

In FIG. 3 the carton 31 is fully encompassed and briefly stopped between the movable plows 28, 28*a* when the plows (shown in phantom) are in their uppermost extended position. The carton 31 is held in this position with the movable plows 28, 28*a* fully extended to maintain compression for a brief period of time before the conveyor moves the carton 31 downstream.

Referring back to FIG. 1, as the movable plows 28, 28*a* are retracted, the conveyor moves the carton which had been maintained in compression between the two movable plows 28, 28*a* downstream between two opposed stationary plows 35, 36 which maintain compression on the end flaps until the glue permanently sets. The conveyor then continues to move the cartons downstream for further processing. Plows 35, 36 are provided with inclined leading edges matching inclined trailing edges of plows 28, 28*a*. The direction of inclination is preferably parallel to the extension and motion of arm 23.

It will be appreciated that to optimize the time saving and the speed increases provided by the invention, the extension motion of the plow can be initiated immediately as the next carton, or its open flap, clears the glue gun. Also, it will be appreciated that the plow retraction can be initiated immediately on initial movement of the next upstream carton into the glue gun. This operation provides a time gain for each compression cycle equal to a very significant portion of the normal closure duration for compression and changing time of prior cartoners where flaps are not closed until the carton comes to rest and the fully retracted plow is not extended until this occurs.

Stated in other words, the invention contemplates extending the plow earlier in the cycle and withdrawing it later, resulting in increased effectiveness and faster cartoning speeds without reduction in the consistency of seal integrity.

Accordingly, the present invention significantly increases the compression time of the end flap sealing operation of a cartoning machine. Also, the cartons may be moved through the carton flap closing and sealing station more quickly than was heretofore possible since the retraction time for the movable plows has been reduced as a result of the unique shape of the closer plow and the design of the reciprocation mechanism. Finally, because of the increased end flap compression time, the end flaps are much less likely to relax and unfold during the sealing operation and thus less likely to stub on parts of the cartoning machine as they move along the conveyor.

Although a preferred embodiment of the invention has been described above, certain modifications will become readily apparent to those of ordinary skill in the art without departing from the scope of the invention. For example, the cam and linkage assembly that comprises the reciprocation mechanism may be substituted by, for example, a fluid operated cylinder controlled by solenoid valves and a control system that operates the cylinder to extend and retract the closer plow in timed relation to the movement of the cartons along the conveyor.

Moreover, the invention provides the advantageous result of closing the carton flaps more quickly after hot melt glue is applied, thus reducing the chance of glue set up and loss of adhesion potential before the flaps are closed.

Other modifications will become readily apparent to those of ordinary skill without departing from the scope of the invention and applicant intends to be bound only by the claims appended hereto.

What is claimed is:

1. A method for sealing conveyed cartons including the steps of:

conveying cartons in a first conveyed direction past a glue station;

applying glue to a carton flap at said glue station to define a first glued carton;

conveying a glued carton in a second conveyed direction to a compression station;

engaging a carton flap of said glued carton at said compression station with a plow having a top edge which slopes toward cartons moving in said first conveyor direction and said plow being movable in a path with a component of motion in a direction toward cartons moving in said first conveyed direction for engaging a carton flap and moving it toward a sealed position; and retracting said plow with a component of motion in said second conveyed direction while said plow is in compression contact with said engaged carton flap and while said glued carton is being conveyed in said second conveyed direction.

2. A method as in claim 1 including the further step of extending said plow in a reciprocal direction with a component of motion in a reverse direction to said second conveyed direction to engage a flap of a second glued carton while remaining in contact with a flap of said first glued carton, and then retracting said plow in a reverse reciprocal direction and with a component of motion in said second conveyed direction while compressing an engaged carton flap toward said second clued carton.

3. In a cartoning machine having a moving conveyor for carrying cartons having end flaps, a glue station wherein glue is applied to a carton end flap, and a stationary plow located adjacent said conveyor downstream of said glue station to engage and compress said carton end flap against other end flaps to seal the end of a carton as it is carried by said conveyor past said stationary plow, the improvement comprising:

a movable closer plow located between said stationary plow and said glue station, said closer plow mounted adjacent said conveyor and having a top edge that slopes toward approaching cartons on said conveyor;

said plow being movable in a reciprocal direction along a path angled toward said approaching cartons; and means for extending and retracting said closer plow in a reciprocal direction along said path to close and seal said carton end flaps.

4. In a cartoning machine as in claim 3 wherein said means for extending and retracting said closer plow comprises a slidable rod attached to said closer plow adjacent said conveyor and including means for moving said rod along a path transverse to said conveyor.

5. In a cartoning machine as in claim 3 wherein the top edge of said closer plow curves outwardly away from said conveyor.

6. In a cartoning machine as in claim 3 further comprising:

a linking rod having first and second ends, said first end pivotally attached to said sliding rod;

a lever having first and second ends, said first end of said lever pivotally attached to said second end of said linking rod and said second end of said lever attached to a shaft; and, cam means for reciprocally rotating said shaft through a predetermined angle to intermittently extend and retract said closer plow to successively close and seal said carton end flaps.

7. In a cartoning machine as in claim 6 wherein said cam means comprises a cam follower mounted on said shaft and a cam rotated in timed relation to the movement of cartons along said conveyor.

8. In a cartoning machine as in claim 7 wherein said cam is rotated in timed relation to the movement of said cartons along said conveyor by drive means used for driving said conveyor.

9. In carton flap closing apparatus having a conveyor for moving cartons in a conveyed direction, the improvement comprising:

a closer plow adapted to be positioned adjacent a moving conveyor carrying cartons having end flaps, said closer plow having a top edge;

means for mounting said closer plow adjacent said conveyor such that said top edge is angled toward approaching cartons on said conveyor; and, means for extending and retracting said closer plow along a reciprocal path angled toward said approaching cartons to close and seal said carton end flaps.

10. In apparatus as in claim 9 wherein said means for mounting, extending and retracting said closer plow comprises a slidably mounted rod to which said closer plow is mounted and which is attached to drive means for reciprocating said rod to extend and retract said closer plow.

11. In apparatus as in claim 10 wherein said rod is angled toward approaching cartons travelling along said conveyor.

12. In apparatus as in claim 11 wherein said drive means comprises a cam rotated in timed relation to the movement of cartons along said conveyor and a cam follower connected through a linkage assembly to said rod.

13. In apparatus as in claim 9 wherein said extending and retracting means move said plow with components of motion in the same direction as the conveyed direction of cartons.

14. A cartoning machine comprising:

a conveyor for carrying cartons having end flaps;

a glue applying station for applying glue to at least one end flap of each carton moving along said conveyor;

a first closer plow mounted alongside said conveyor downstream of said glue applying station for reciprocation along a path that is angled toward approaching cartons travelling along said conveyor; and, drive means for reciprocating said closer plow between a retracted position for allowing a carton to move alongside said closer plow and an extended position for closing and sealing said end flaps.

15. The cartoning machine of claim 14 further comprising:

a second closer plow mounted alongside said conveyor across said conveyor from said first closer plow for reciprocation along a path that is angled toward said approaching cartons, wherein said drive means reciprocates said first and second closer plows together to close and seal end flaps on opposite sides of each carton.

16. A method of closing and sealing end flaps of cartons moving along a conveyor comprising:

(a) conveying cartons along a conveyor;

(b) applying glue to at least one open end flap on a first end of each carton moving along said conveyor; and, (c) reciprocating a first movable closer plow by extending and retracting said plow along a reciprocal path which is angled toward approaching cartons on said conveyor to successively close, compress and seal said open end flap against other end flaps of each carton as said cartons pass said closer plow.

17. The method of claim 16 further comprising the steps of:

(d) applying glue to at least one open end flap on a second end of each carton moving along said conveyor.

(e) moving a second closer plow located on the opposite side of said conveyor from said first closer plow along said path that is angled toward said approaching cartons to successively close, compress and seal end flaps on said second end of each said carton moving along the conveyor.

18. The method of claim 16 wherein said method includes extending said plow with a component of motion in an upstream direction with respect to said cartons.

19. The method of claim 16 wherein said method includes retracting said plow with a component of motion in a downstream direction with respect to said cartons.

20. The method of claim 16 wherein glue is applied to said cartons by a glue gun including moving said plow to close, compress and seal said flap immediately upon said cartons clearing said glue gun.

21. A method as in claim 20 wherein said plow is retracted upon a carton moving into said glue gun.

* * * * *